US010934779B2

(12) United States Patent
Bauer

(10) Patent No.: US 10,934,779 B2
(45) Date of Patent: Mar. 2, 2021

(54) ROTARY DRILLING TOOL AND METHOD FOR PRODUCING A BORE

(71) Applicant: BAUER Maschinen GmbH, Schrobenhausen (DE)

(72) Inventor: Sebastian Bauer, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 37 days.

(21) Appl. No.: 16/469,275

(22) PCT Filed: Nov. 27, 2017

(86) PCT No.: PCT/EP2017/080474

§ 371 (c)(1),
(2) Date: Jun. 13, 2019

(87) PCT Pub. No.: WO2018/114230

PCT Pub. Date: Jun. 28, 2018

(65) Prior Publication Data

US 2020/0102790 A1 Apr. 2, 2020

(30) Foreign Application Priority Data

Dec. 19, 2016 (DE) ..... 16205044.7

(51) Int. Cl.
*E21B 10/02* (2006.01)
*E21B 10/60* (2006.01)
(Continued)

(52) U.S. Cl.
CPC ..... *E21B 6/04* (2013.01); *E21B 4/14* (2013.01); *E21B 10/02* (2013.01); *E21B 10/60* (2013.01)

(58) Field of Classification Search
CPC . E21B 10/60; E21B 10/02; E21B 4/14; E21B 6/04; E21B 4/16; E21B 6/00
See application file for complete search history.

(56) References Cited

U.S. PATENT DOCUMENTS 1,891,416 A * 12/1932 Harris ..... E21B 6/00 175/96
4,183,415 A * 1/1980 Stenuick ..... E21B 7/208 175/171
(Continued)

FOREIGN PATENT DOCUMENTS

DE 1187566 B * 2/1965 ..... E21B 10/66
DE 2732147 A * 1/1978
(Continued)

OTHER PUBLICATIONS

International Preliminary Report on Patentability issued in PCT/EP2017/080474; dated Apr. 1, 2019.
(Continued)

*Primary Examiner* — Daniel P Stephenson
(74) *Attorney, Agent, or Firm* — Studebaker & Brackett PC

(57) ABSTRACT

The invention relates to a rotary drilling tool and to a method for producing a borehole in the ground, having a base body, a removal device which has at least one hammer unit which comprises a hammer element driven in axially reversing manner, and a discharge line for discharging removed ground material and drilling suspension. According to the invention it is provided that a pumping device is arranged on the base body along the discharge line, and that the pumping device is configured for pumping off the removed ground material with drilling suspension through the discharge line.

12 Claims, 7 Drawing Sheets

(51) Int. Cl.
*E21B 4/14* (2006.01)
*E21B 6/04* (2006.01)

(56) References Cited

U.S. PATENT DOCUMENTS 4,790,391 A * 12/1988 Hamamura ..... E21B 4/14 173/198
5,009,271 A * 4/1991 Maric ..... E21B 7/208 175/171
5,009,274 A * 4/1991 Lof ..... E21B 7/20 175/260
5,267,622 A * 12/1993 Fletcher ..... E21B 4/06 175/14
6,189,630 B1 * 2/2001 Beck, III ..... E21B 4/16 175/108
6,209,665 B1 * 4/2001 Holte ..... E21B 4/14 175/273
6,607,046 B1 * 8/2003 Betts ..... E21B 10/086 175/272
7,290,624 B2 * 11/2007 Mocivnik ..... E21B 4/16 175/293
2010/0084193 A1 * 4/2010 Livingstone ..... E21B 10/02 175/58
2020/0102790 A1 * 4/2020 Bauer ..... E21B 10/02

FOREIGN PATENT DOCUMENTS

DE 102008028997 A1 * 1/2010 ..... E21B 7/00
EP 2 592 214 A1 5/2013
EP 2 597 249 A1 5/2013
EP 2597249 A1 * 5/2013 ..... E21B 10/327
EP 2 703 596 B1 2/2015
GB 191013575 A 6/1911
WO 83/00183 A1 1/1983

OTHER PUBLICATIONS

International Search Report issued in PCT/EP2017/080474; dated Feb. 8, 2018.

* cited by examiner

ROTARY DRILLING TOOL AND METHOD FOR PRODUCING A BORE

The invention relates to a rotary drilling tool for producing a bore in the ground, having a base body, a removal device which is arranged on an underside of the base body and has at least one hammer unit which comprises at least one hammer element driven in axially reversing manner, and a discharge line for discharging removed ground material and drilling suspension.

The invention further relates to a method for producing a bore in the ground by means of a rotary drilling tool, in which ground material is removed by means of a removal device on an underside of a base body of the rotary drilling tool, and removed ground material and drilling suspension are discharged by means of a discharge line, wherein the removal device has at least one hammer unit in which a hammer element is driven in axially reversing manner.

A rotary drilling tool of the generic type is disclosed in EP 2 592 214 A1. In this rotary drilling tool there is provided a plurality of hammer units having hammer elements movable in axially reversing manner, which are driven by means of compressed air. A striking movement of the hammer elements is thereby generated, by means of which hard ground, in particular stone, can be removed. Used compressed air is thereby able to emerge at a lower region of the hammer units, the compressed air being used for carrying away removed ground material and drilling suspension in the so-called air-lift process. The compressed air that is released can thereby flow upwards through discharge lines. Ground material and drilling suspension are discharged upwards out of the borehole with the compressed air.

From EP 2 703 596 B1 there is known a drilling device which can be arranged inside a support pipe and can be clamped on the inside of the drill pipe in order to produce the bore. Inside the drilling device there are arranged a rotary drive, a feed drive, a clamping device for clamping the housing in the support pipe, and further units for the supply and discharge of suspensions. Removal of the ground material takes place via rotating cutting devices.

Drilling tools having rotating cutting teeth are suitable for working ground of low or medium hardness, whereby ground material is in particular peeled off. For working ground of high hardness, in particular bedrock and rocks, working by means of rotary bits or actively driven hammer units is necessary. These exert a high pressure load at certain points on hard brittle material, which results in ground material flaking and thus being removed.

EP 2 597 249 A1 discloses a drilling instrument and a method for producing a vertical bore. For that purpose, an eccentrically arranged, rotating drill head is provided on a drilling device at a lower end.

WO 83/00183 teaches a drilling hammer having a single drill head, which is arranged at a lower end of the drilling device.

The object underlying the invention is to provide a rotary drilling tool and a method for producing a bore in the ground, with which a particularly good removal rate can be achieved in particular in the case of a hard ground material.

The rotary drilling tool according to the invention is characterized in that a pumping device is arranged on the base body along the discharge line, and in that the pumping device is configured to pump-off the removed ground material with drilling suspension through the discharge line.

A fundamental idea of the invention is based on the finding that, in the case of hammer units having hammer elements driven in reversing manner, it is essential for a good removal rate that said hammer elements strike the bedrock hard ground material as directly as possible. The impact energy can thereby efficiently be converted into overloading of the ground material at certain points, which leads to flaking or fragmenting of the bedrock ground material.

The use of a pumping device directly at the discharge line on the rotary drilling tool itself has the effect that removed ground material is discharged from the working area with drilling suspension particularly reliably and quickly. This has the effect that, when the hammer elements strike the in-situ ground, the impact energy is not reduced and dampened by removed ground material which has not yet been discharged. Immediate and rapid discharge of the removed ground material by a pumping device in the rotary drilling tool itself accordingly has the effect that as high a proportion as possible of the impact energy is applied to the bedrock ground. A high removal rate is thereby achieved.

In principle, the hammer unit can be driven in any desired manner, for example by means of electrical energy or by means of a hydraulic fluid. According to one embodiment of the invention, it is particularly advantageous that the at least one hammer unit is operated by means of compressed air, which is supplied via a supply line. The compressed air is fed from outside the borehole by a compressor, which is preferably arranged on the drilling device, by means of which a rotary movement is also applied to the rotary drilling tool.

A preferred further development of the invention consists in that an outlet opening for used compressed air is provided at a lower end region of the at least one hammer unit. The used compressed air thus likewise exits into the region in which ground removal takes place. The compressed air can thereby flow upwards in the borehole filled with drilling suspension for the discharge of removed ground material. In accordance with the air-lift process, the compressed air flowing upwards carries with it removed ground material and drilling suspension to a certain extent. The flow generated by the pumping device can thereby be assisted. Any suitable pump can in principle be used as the pumping device, in particular a screw pump. One or more pumps can be provided.

A further preferred embodiment of the invention consists in that the hammer element has a vertically oriented piston which is displaceably mounted in a cylinder housing of the hammer unit. The rotary drilling tool can have a plurality of hammer units which are of identical construction. The hammer units can in particular be in modular type formed from the cylinder housing with the piston mounted therein. The supply and discharge of compressed air is thereby controlled such, that an up-and-down movement of the piston is achieved with a desired frequency.

The hammer units are arranged in a substantially cylindrical housing of the rotary drilling tool. A preferred implementation variant of the invention can be seen in that the pumping device is arranged above the removal device in a housing. The housing can thereby upwardly lengthen a cylindrical base body with the removal device. Inside the upper portion in the housing, the pumping device is preferably arranged centrally. From outside the borehole, energy for operating the pumping device can be supplied via an energy supply line, in particular an electrical line or a compressed fluid line.

In a rotating drilling tool, a so-called rotary feedthrough or a rotary contact with an annular contact strip can be provided in a manner which is known per se, so that energy can be transmitted to the rotating drilling tool from outside from a fixed energy supply.

According to a further development of the invention, it is advantageous that a connecting device for a drill string is arranged on an upper side of the housing. The connecting device can in particular be a so-called Kelly box for connection of a Kelly drill string. Other mechanical connecting devices for connecting the rotary drilling tool to a drill string in a torque proof manner can also be used.

A particularly efficient extraction of removed ground material is achieved according to a further development of the invention in that the pumping device is arranged on a central portion of the discharge line, and in that the discharge line divides into a plurality of discharge lines beneath the central portion. The pumping device is thus arranged centrally on an approximately middle portion of the discharge line, whereby the suction power of the pump can be divided over a plurality of discharge lines beneath the central portion.

It is particularly advantageous thereby that at least one suction opening for extraction of the removed ground material is arranged on an underside of the base body. Each extraction opening is thereby connected to a discharge sub-line which leads to the central portion having the pumping device. Via a plurality of extraction openings, the processed ground material can be extracted particularly reliably over the entire bore section and discharged upwards.

A possible embodiment of the rotary drilling tool according to the invention consists in that the rotary drilling tool is in the form of a full-face drilling tool. The downwardly directed end face of the rotary drilling tool is thereby substantially plate-shaped, wherein a plurality of hammer elements protrude for removing the in-situ ground. With simultaneous rotation of the rotary drilling tool, the ground can thus be worked over a particularly large area.

Alternatively, it can be provided according to a further development of the invention that the rotary drilling tool is in the form of a core drilling tool. The hammer units as the removal device are thereby located along an annular edge region of the base body. There remains in the middle a free receiving space for receiving a drill core that forms during drilling. Usually, the drill core can break off by itself above a particular length owing to the transverse forces that occur on drilling. Preferably, an active device for breaking or working off the drill core can also be provided. The drill core can be discharged from the borehole by the rotary drilling tool or a separate core catcher.

It is further advantageous according to an implementation variant of the invention that an energy supply line is provided, by means of which the pumping device on the base body is supplied with energy, in particular electrical or hydraulic energy. The pumping device can be operated particularly reliably with this energy supply. It is also readily possible to adjust the pumping capacity as required. Alternatively, the pumping device can also take place by tapping torque from the drill string.

The method according to the invention is characterized in that a pumping device is arranged on a base body of the rotary drilling tool along the discharge line, by means of which pumping device the removed ground material is pumped with drilling suspension through the discharge line to the outside of a borehole.

The method according to the invention is preferably carried out with the rotary drilling tool according to the invention, as has been described hereinbefore. With the method according to the invention, the above-described advantages in particular in respect of a high removal rate can be achieved.

A preferred variant of the method according to the invention consists in operating the hammer unit with compressed air, which emerges at an underside of the base body. The emerging compressed air can assist with carrying off removed ground material with drilling suspension upwards into the discharge line.

According to a further implementation variant of the invention, particularly reliable extraction is achieved in that the removed ground material and the drilling suspension are extracted via a plurality of extraction openings and a plurality of extraction lines which open into a central portion on which the pumping device is arranged. The extraction capacity of the pump is thus distributed to a plurality of extraction sub-lines and a plurality of extraction openings. This facilitates reliable and rapid discharge of the removed ground material.

The invention will be described further hereinbelow with reference to preferred exemplary embodiments which are shown schematically in the drawings, in which.

and

Figure 4:
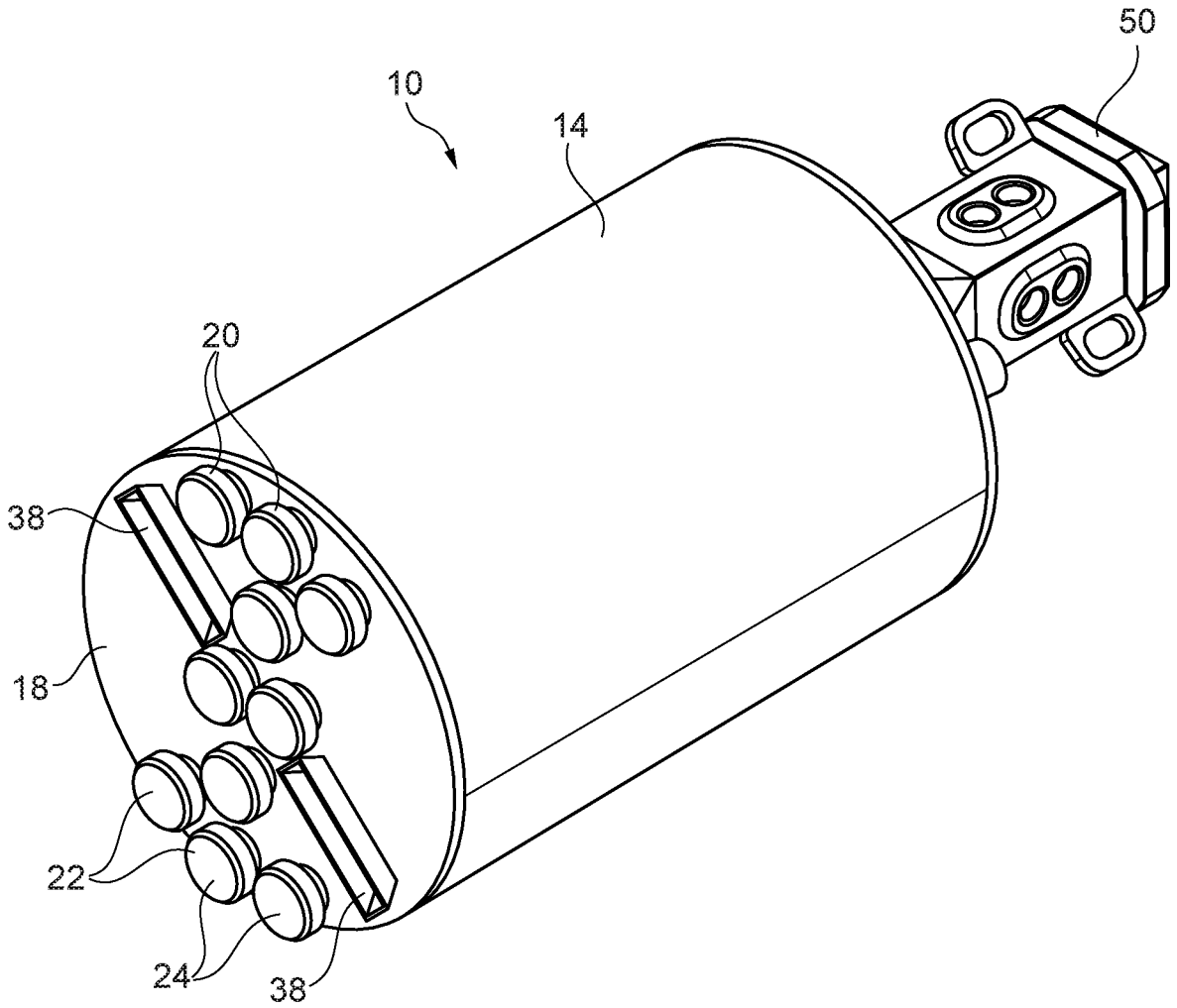
FIG. 4 is a perspective view of a second rotary drilling tool according to the invention.
Figure 5:
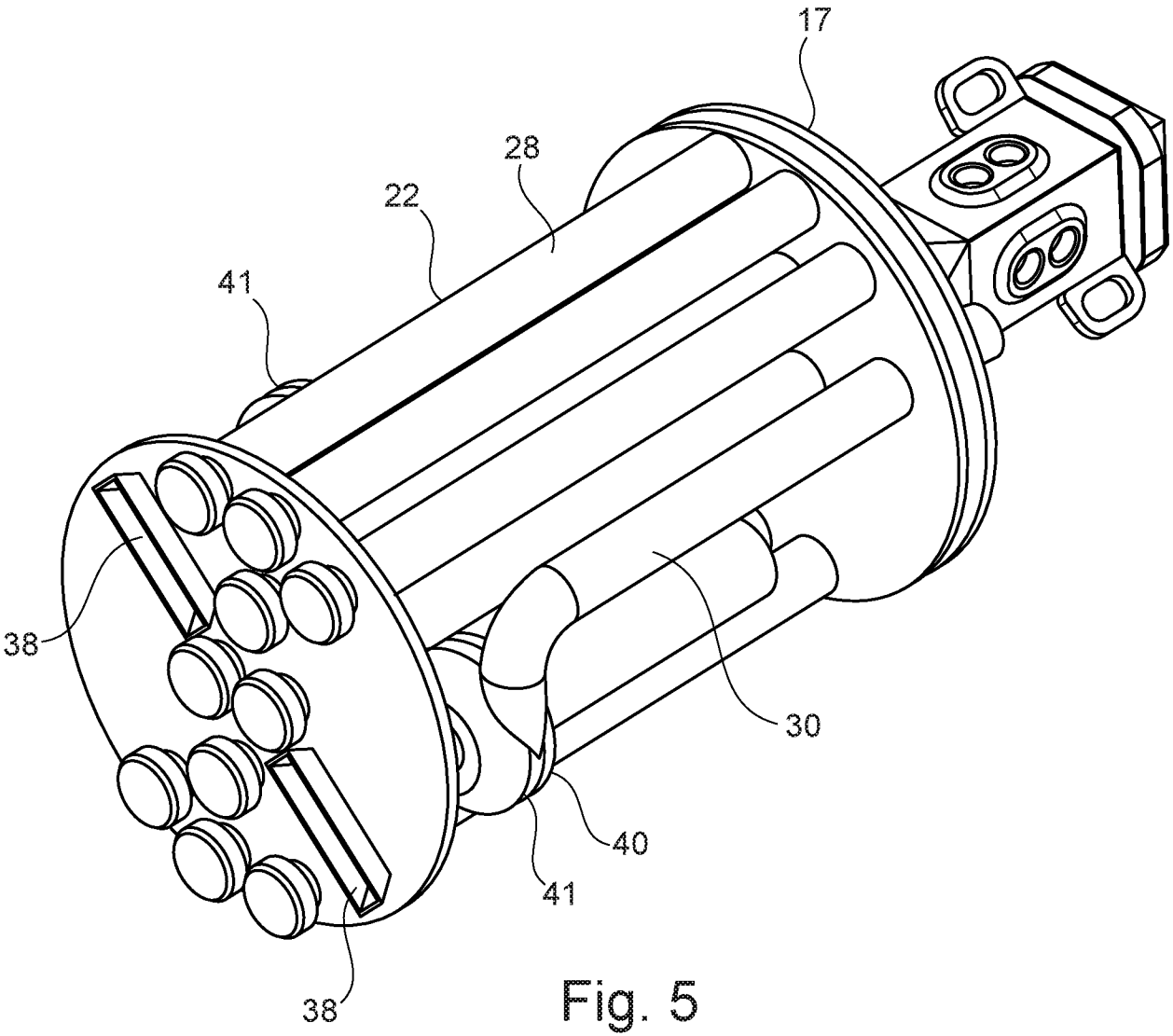
FIG. 5 is a perspective view of a rotary drilling tool of FIG. 4 without a housing.
Figure 6:
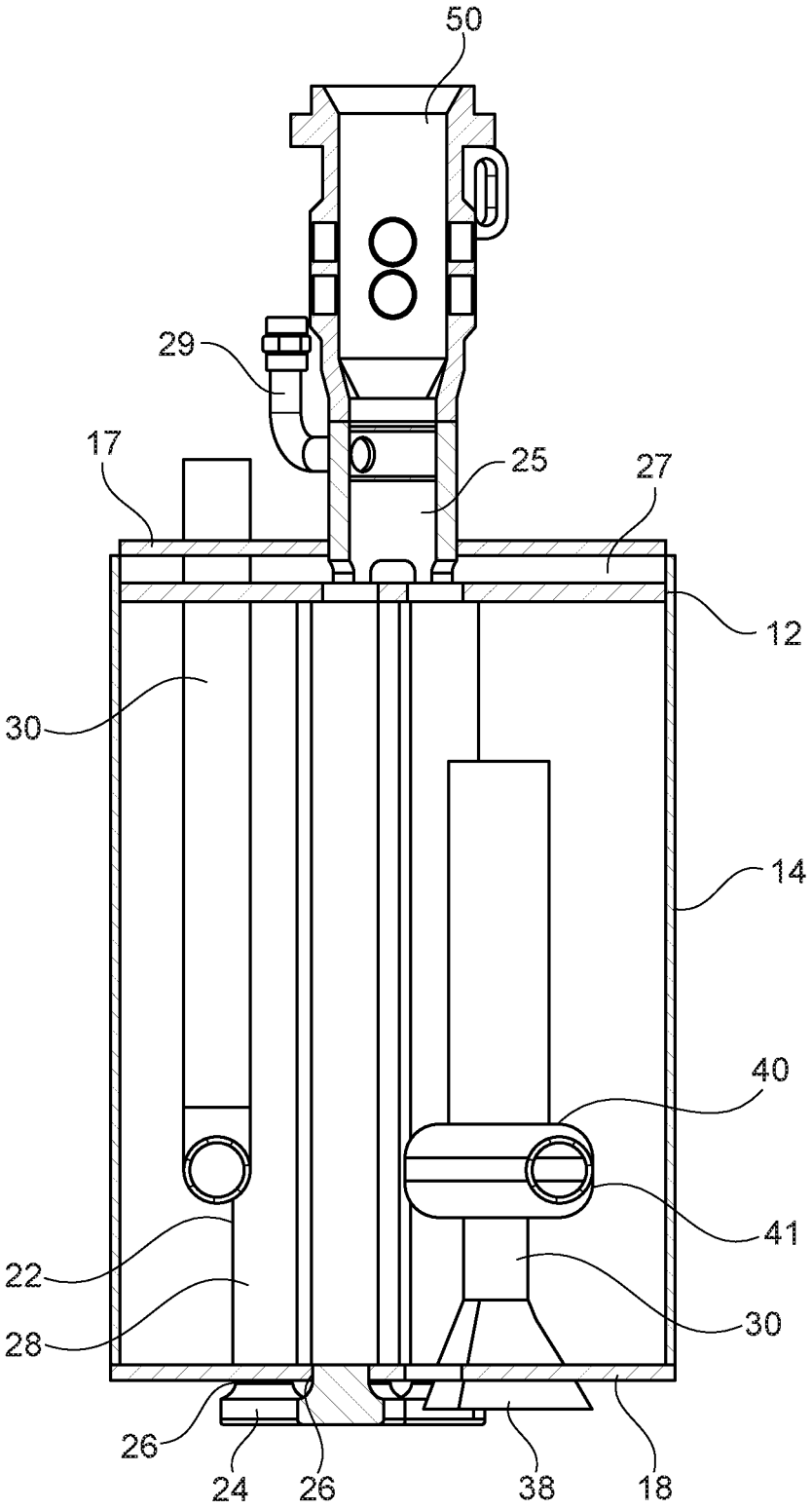
FIG. 6 is a sectional view of the rotary drilling tool of FIG. 4 in a longitudinal section.
Figure 7:
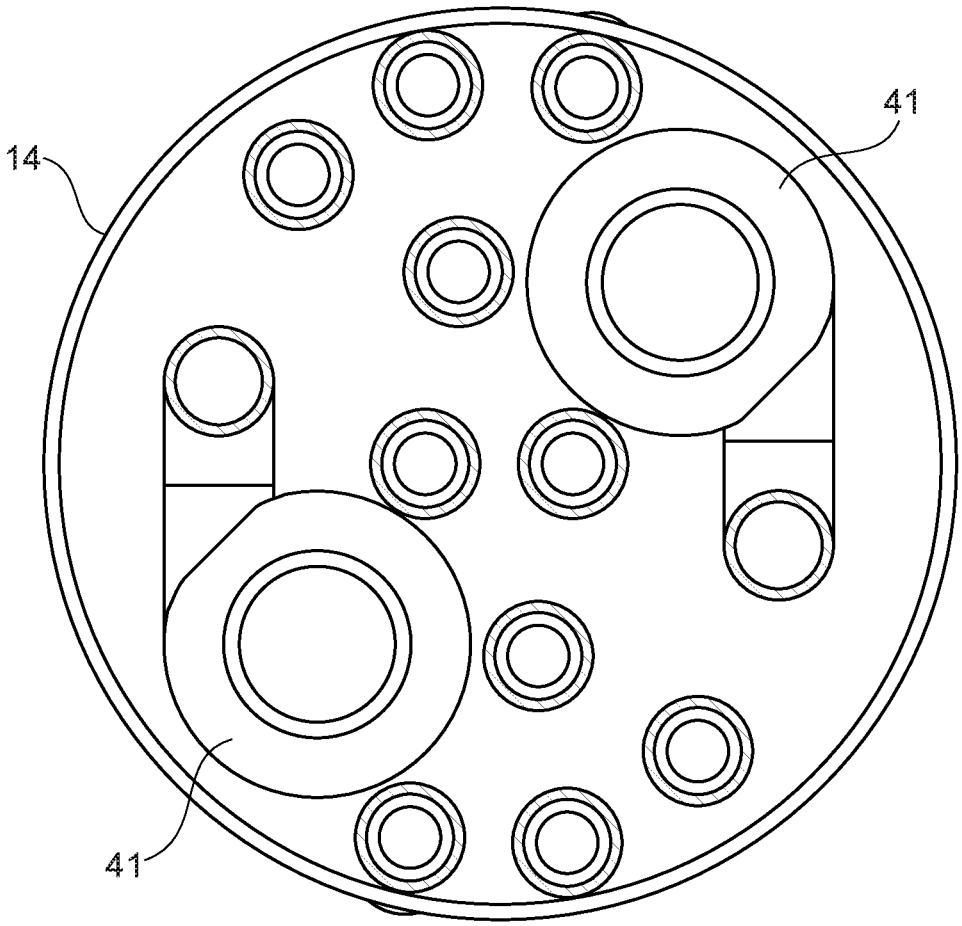

FIG. 7 is a sectional view of the rotary drilling tool of FIG. 4 in a cross-section transversely to the longitudinal axis.

Figure 1:
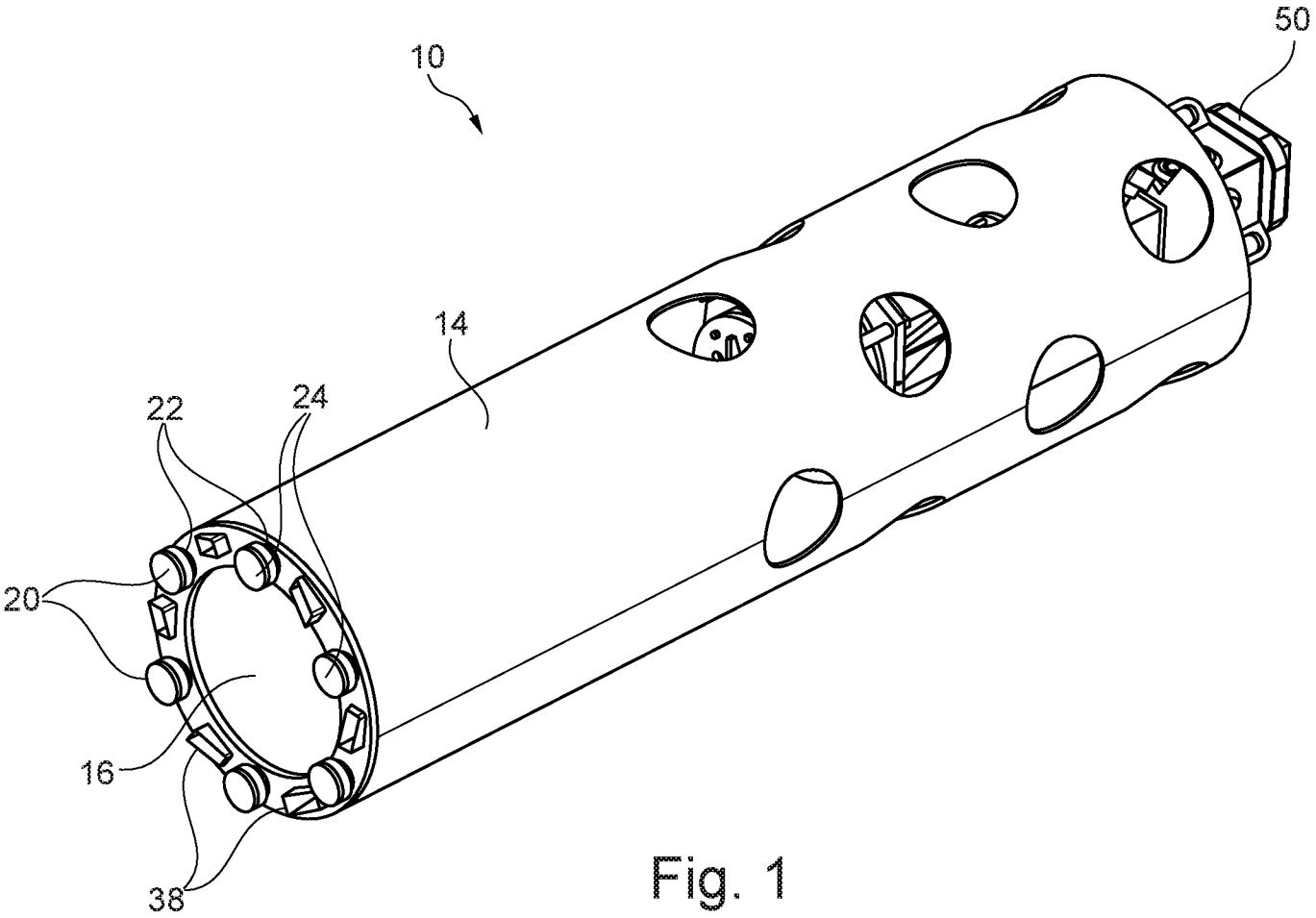
FIG. 1 is a perspective view of a first rotary drilling tool according to the invention.

A first rotary drilling tool 10 according to the invention is described hereinbelow in conjunction with FIGS. 1 to 3. The rotary drilling tool 10 is in the form of a core drilling tool with an annular arrangement of the removal device 20 around a central hollow core receptacle 16. In the exemplary embodiment shown, the removal device 20 has six hammer units 22 of identical construction having a circular disc-shaped hammer element 24. On the underside of the axially movable hammer elements 24 there are arranged removal elements (not shown in greater detail), which are preferably acute tapering cemented carbide elements. Between the individual hammer units 22 there are arranged extraction openings 38 for the extraction of the removed ground material with surrounding drilling suspension. The extraction openings 38 are angled in a direction of rotation in order to achieve a material uptake as good as possible.

The rotary drilling tool 10 comprises a cylindrical housing 14, at the upper end of which there is mounted a connecting device 50 for a drill string. The connecting device 50 is preferably in the form of a so-called Kelly box for receiving a square end of a drill string.

Figure 2:
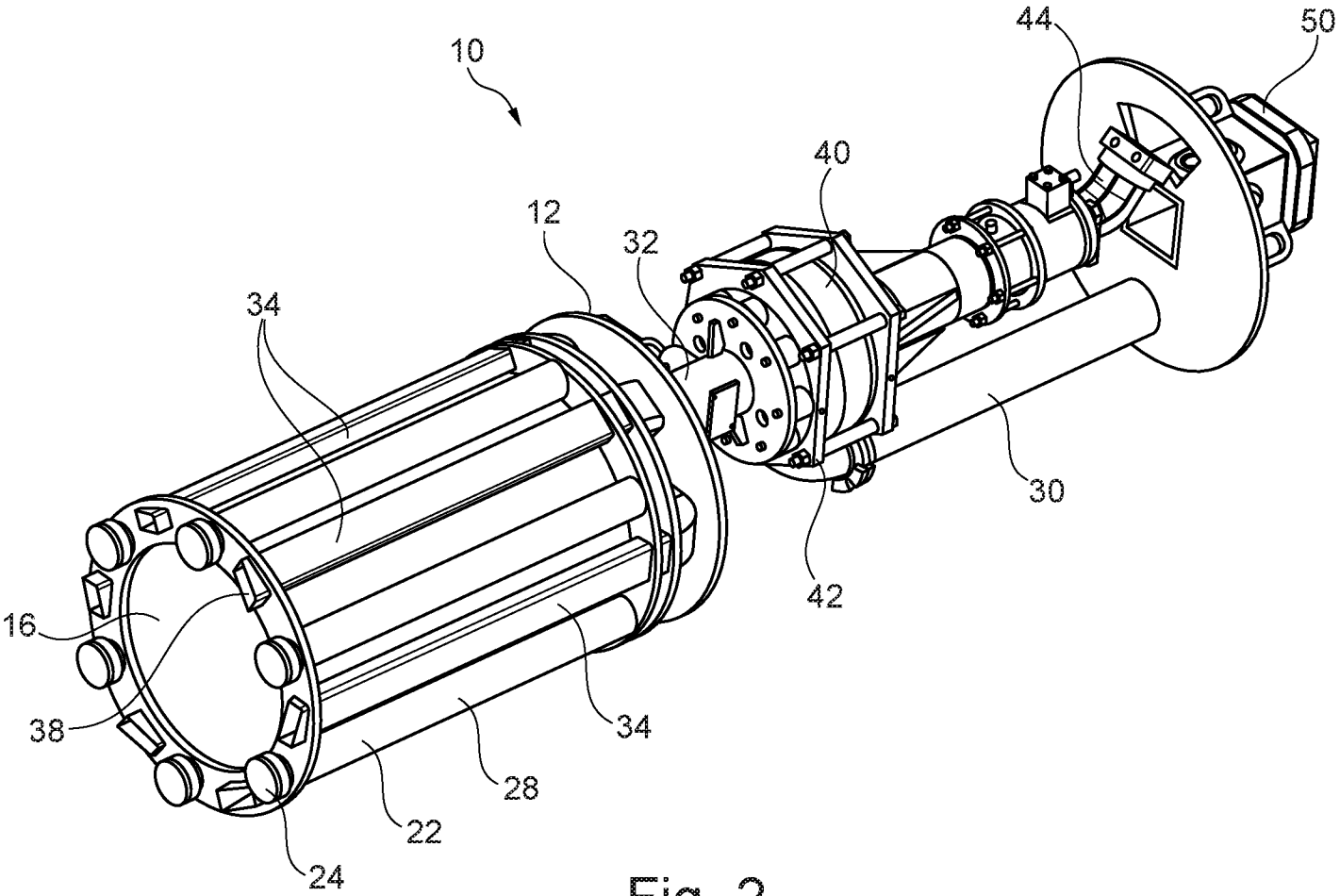
FIG. 2 is a perspective view of the rotary drilling tool of FIG. 1 without a housing.
Figure 3:
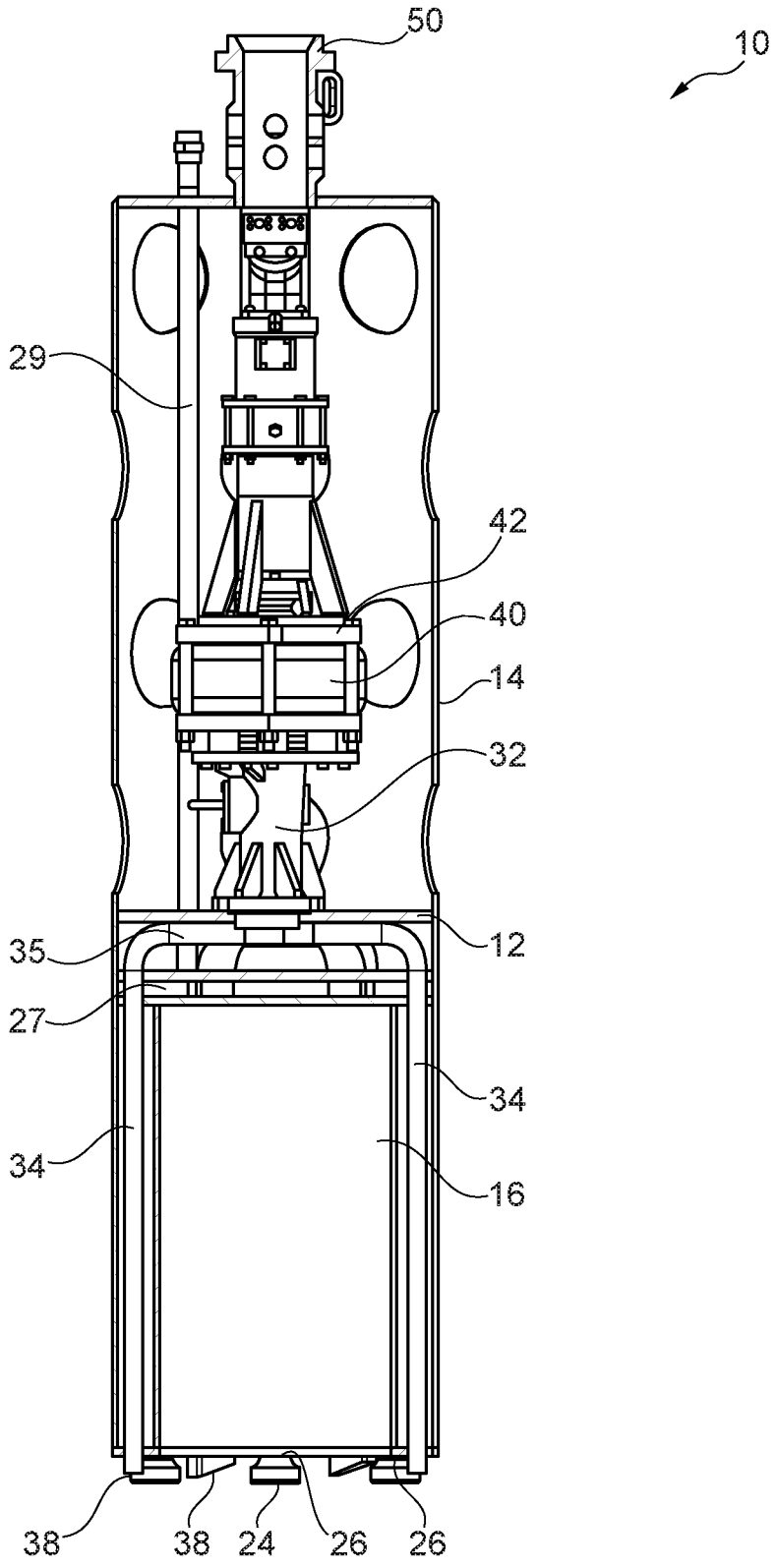
FIG. 3 is a sectional view of the rotary drilling tool of FIG. 1 in a longitudinal section.

As is shown clearly in FIG. 2, the individual hammer units 22 have an elongate cylindrical cylinder housing 28 in which a piston 26 is displaceably mounted in reversing manner between a lower striking position and an upper pull-back position. The disc-shaped hammer element 24 is attached to a lower end of the piston 26, which is merely indicated in FIG. 3.

The hammer units 22 are supplied with compressed air via a supply line 29. The supply line 29, which runs vertically upwards outside the borehole, opens at its lower end into a transverse line 27 which leads to the individual hammer units 22. The transverse line 27 is formed between two cover plates. At a lower end region of the hammer units 22, used compressed air can emerge at the underside of the base body 12 of the rotary drilling tool 10.

Removed ground material and surrounding drilling suspension as well as emerging compressed air are discharged via the obliquely-directed extraction openings 38 via the individual discharge sub-lines 34. The discharge sub-lines 34 are thereby connected via transverse channels 35 to a central portion 32 of an upwardly guided discharge line 30. A pumping device 40 arranged centrally in the housing 14 is positioned on the central portion 32. The pumping device 40 is provided via an energy supply line 44 with driving energy, in particular electrical energy, from a carrier device outside the borehole. From the central portion 32, the ground material taken in is carried upwards by the pumping device 40 via the discharge line 30. The pumping device 40 is fixedly connected to the base body 12 of the rotary drilling tool 10 via a pump housing 42 and the central portion 32.

FIGS. 4 to 7 show a second rotary drilling tool 10 according to the invention, which is in the form of a full-face drilling tool. The rotary drilling tool 10 has a cylindrical housing 14, at the lower end of which there is arranged a removal device 20 which extends substantially transversely over a circular disc-shaped base plate 18. The removal device 20 is formed of a plurality of hammer units 22 having circular disc-shaped hammer elements 24. Furthermore, two radially extending slot-like extraction openings 38 for the extraction of removed ground material and surrounding ground suspension are arranged on the base plate 18. As in the rotary drilling tool 10 described hereinbefore, a Kelly box is attached to the upper side of the housing 14 as a connecting device 50 for a drill string.

Inside the cylindrical housing 14, which in this rotary drilling tool 10 constitutes a substantial portion of the base body 12, there are arranged the rod-shaped hammer units 22 with their respective cylinder housings 28. Inside the cylinder housings 28 there are mounted in axially reversing manner pistons 26 driven by compressed air for exerting a striking movement on the in-situ working area. Disc-shaped hammer elements 24 having removal elements (not shown) are attached to the lower ends of the pistons 26.

Removed ground material is extracted via the two elongate extraction openings 38. In the present exemplary embodiment, the pumping device 40 has two separate pumps 41, each pump 41 being line-connected via its own discharge line 30 to a suction opening 38.

For supplying compressed air to the hammer units 22 there is provided a supply line 29 which extends upwards and opens in its lower region into a central pipe portion 25, which is formed beneath the connecting device 50. Fed compressed air is guided further from the pipe portion 25 via a transverse line 27 formed in a cover plate 17 to the individual hammer units 22.

In operation, the rotary drilling tool 10 is driven in rotation via a drill string (not shown), so that the removal device 20 with the hammer units 22 sweeps over the entire in-situ working area.

The invention claimed is:

1. A rotary drilling tool for producing a bore in the ground, comprising:

a base body; and a discharge line for discharging removed ground material and drilling suspension, wherein a pumping device is arranged on the base body along the discharge line, the pumping device being configured for pumping off the removed ground material with a drilling suspension through the discharge line, a removal device is arranged on an underside of the base body, the removal device comprising a plurality of hammer units which each comprise a hammer element driven in axially reversing manner, the hammer elements each comprise a vertically oriented piston which is in each case displaceably mounted in a cylinder housing of the hammer unit, multiple extraction openings, for extraction of the removed ground material, are arranged on an underside of the base body, and an energy supply line is provided such that the pumping device on the base body is supplied with electrical energy or hydraulic energy.

2. The rotary drilling tool according to claim 1, wherein the hammer units are operated with compressed air supplied via a supply line.

3. The rotary drilling tool according to claim 2, wherein an outlet opening for used compressed air is provided at a lower end region of the hammer units.

4. The rotary drilling tool according to claim 1, wherein the pumping device is arranged above the removal device in a housing.

5. The rotary drilling tool according to claim 4, wherein a connecting device for a drill string is arranged on an upper side of the housing.

6. The rotary drilling tool according to claim 1, wherein the pumping device is arranged on a central portion of the discharge line, and beneath the central portion, the discharge line divides into a plurality of discharge sub-lines.

7. The rotary drilling tool according to any claim 6, wherein each extraction opening is connected with a discharge sub-line, which leads to the central section with the pumping device.

8. The rotary drilling tool according to claim 1, wherein the rotary drilling tool is in the form of a full-face drilling tool.

9. The rotary drilling tool according to claim 1, wherein the rotary drilling tool is in the form of a core drilling tool.

10. A method for producing a bore in the ground by means of the rotary drilling tool according to claim 1, wherein ground material is removed by means of the removal device on the underside of the base body of the rotary drilling tool, the removed ground material and a drilling suspension are discharged by means of a discharge line, and the pumping device is arranged on the base body of the rotary drilling tool along the discharge line such that the removed ground material with the drilling suspension is pumped through the discharge line to the outside of a borehole.

11. The method according to claim 10, wherein at least one hammer unit is operated with compressed air which emerges at an underside of the base body.

12. The method according to claim 10, wherein the removed ground material and the drilling suspension are extracted via the plurality of extraction openings and a plurality of discharge sub-lines which open into a central portion on which the pumping device is arranged.

* * * * *